US005460092A

United States Patent [19]

Beisel et al.

[11] Patent Number: 5,460,092

[45] Date of Patent: Oct. 24, 1995

[54] DEVICE FOR FEEDING A PRINTING PLATE TO A PLATE CYLINDER OF A PRINTING PRESS

[75] Inventors: Hermann Beisel, Walldorf; Christian Compera, Dossenheim, both of Germany

[73] Assignee: Heidelberger Druckmaschinen AG, Heidelberg, Germany

[21] Appl. No.: 54,964

[22] Filed: Apr. 29, 1993

[30] Foreign Application Priority Data

Apr. 29, 1992 [DE] Germany ..... 42 14 049.8

[51] Int. Cl.[6] ..... B41F 30/00

[52] U.S. Cl. ..... 101/477; 101/415.1

[58] Field of Search ..... 101/477, 415.1, 101/378

[56] References Cited

U.S. PATENT DOCUMENTS

| | | | |
|---|---|---|---|
| 5,094,165 | 3/1992 | Sugiyama et al. | 101/415.1 |
| 5,127,322 | 7/1992 | Kobler | 101/378 |
| 5,218,907 | 6/1993 | Komori et al. | 101/477 |
| 5,289,773 | 3/1994 | Saito et al. | 101/415.1 |
| 5,361,699 | 11/1994 | Compera | 101/477 |

FOREIGN PATENT DOCUMENTS

| | | | |
|---|---|---|---|
| 0433798 | 6/1991 | European Pat. Off. . | |
| 0435410 | 7/1991 | European Pat. Off. . | |
| 8215605 | 9/1982 | Germany . | |
| 313062 | 2/1984 | Japan . | |
| 0022755 | 2/1984 | Japan | 101/415.1 |
| 61-248834 | 11/1986 | Japan . | |
| 60159542 | 1/1987 | Japan . | |
| 62-19458 | 1/1987 | Japan . | |
| 1176558 | 7/1989 | Japan . | |
| 4284252 | 10/1992 | Japan | 101/415.1 |
| 1006042 | 9/1965 | United Kingdom . | |

*Primary Examiner*—Ren Yan
*Assistant Examiner*—Anthony H. Nguyen
*Attorney, Agent, or Firm*—Herbert L. Lerner; Laurence A. Greenberg

[57] ABSTRACT

Device for feeding a printing plate to a plate cylinder of at least one printing unit of a printing press, the plate cylinder having a clamping device formed with clamping surfaces for clamping a leading edge of the printing plate therein, includes at least one element for holding and guiding the printing plate, the one element being a readily rotatable roller having an outer cylindrical surface which, in a plate-changing position, is disposed substantially tangentially to a straight line disposed between the roller and the one printing unit, the straight line extending parallel to the clamping surfaces of the clamping device, passing between the clamping surfaces and leaving the one printing unit in an upwardly inclined direction.

14 Claims, 9 Drawing Sheets

9
12
11
25
32
47
6
14
46
23
13
35
24
1
28
31
10
3
17
29
16
18
2
28
15
45
7
4
8
5
30

DEVICE FOR FEEDING A PRINTING PLATE TO A PLATE CYLINDER OF A PRINTING PRESS

SPECIFICATION

The invention relates to a device for feeding a printing plate to a plate cylinder of a printing press, provided with a device for clamping the printing plate, the feeding device including a device with at least one element for holding and guiding the printing plate.

Heretofore, clamping a printing plate on the plate cylinder of a printing press has been a conventional manual operation to be performed by the pressman. For this purpose, devices for clamping the printing plate have been used, which received and held the leading edge and the trailing edge of the printing plate therein and were able to be closed and opened by means of a key or a mandrel. The printing plate was conventionally inserted manually into such heretofore known clamping devices.

A first improvement in this field related to clamping devices for printing plates, which were able to be opened and closed by the press of a button. With such devices, the printing plate was automatically clamped at the leading and trailing ends thereof and then subjected to tension, the trailing end of the printing plate being inserted by a press-on element into the device for receiving and holding the trailing end of the printing plate. The next automatizing step subsequent thereto relates to a device for feeding a printing plate to such an automatized device for clamping the leading edge of a printing plate.

A device of the last-mentioned type has become known heretofore from the published Japanese patent document Hei 3-13062. With this heretofore known device, the printing plate is placed in holders, and supporting parts hold the leading edge of the printing plate. To permit the printing plate to be fed, the supporting parts release the printing plate, which then passes through a guide which, in turn, feeds the leading edge of the printing plate along an arcuate path to the device for clamping the leading edge of the printing plate. The guide for feeding the printing plate is formed of two pairs of rollers which grip the printing plate at the left-hand and right-hand margins thereof and transport it.

This known device is of complex construction, however, and it appears questionable as to how the printing plate is supposed to describe the arcuate path. Even if success is achieved in guiding the printing plate on such a path, guides must be provided along which the printing plate can slide. Inaccuracies and the risk of damage to the printing plate are the consequences. A further reason for inaccurate feeding of the printing plate is that the printing plate tends to sag in a central region thereof, due to which precise feeding is no longer assured. Due to the use of the guide with the two pairs of rollers, the feeding of a printing plate which has a trailing edge bent away at an angle is not possible.

A further device of the type mentioned in the introduction hereto has become known from the published Japanese patent document Sho 62-19458. The device disclosed therein has two parallel guide rails through which the printing plate is made to pass. At an upper end thereof, the guide rails are formed with a funnel-shaped opening for the insertion of the printing plate, and they are bent so that the printing plate may be fed to the device for clamping the printing plate on the plate cylinder.

With this known device, the risk of damage to the printing plate is extremely high, because the printing plate slides with both sides thereof along the guide. If, in order to prevent damage, the guides are constructed so that they grip only narrow marginal regions on the left-hand and right-hand sides of the printing plate, sagging of the printing plate occurs, as in the aforementioned prior art, and the printing plate can no longer be fed with accuracy. Moreover, this device does not permit feeding of printing plates with respective trailing ends which are bent away at an angle. Having such an angularly bent-away section, however, is of great advantage for the automatic clamping and tensioning of a printing plate because, when a printing plate with such a bent-away end section is subjected to tension, a greater tensioning force is possible than in the case of a printing plate with a trailing end which is not bent away at an angle.

Furthermore, a device for feeding a printing plate has become known heretofore also from the published Japanese patent document Sho 61-248834. In this device, the printing plate is disposed in a magazine which is available, via transport devices, for pulling out and inserting the printing plate. Just how the printing plate is actually guided is not disclosed, however, in this publication. Also, the question as to how a printing plate with a bent-away trailing edge can be fed to a plate cylinder is not answered by this publication.

t is, accordingly, an object of the invention to provide a device of the type mentioned in the introduction hereto, which permits, in a relatively simple manner, precise feeding of a printing plate to the plate cylinder of a printing press, while maximum care is taken of the printing area.

With the foregoing and other objects in view, there is provided, in accordance with the invention, a device for feeding a printing plate to a plate cylinder of at least one printing unit of a printing press, the plate cylinder having a clamping device formed with clamping surfaces for clamping a leading edge of the printing plate therein, the feeding device comprising at least one element for holding and guiding the printing plate, the one element being a readily rotatable roller having an outer cylindrical surface which, in a plate-changing position, is disposed substantially tangentially to a straight line disposed between the roller and the one printing unit, the straight line extending parallel to the clamping surfaces of the clamping device, passing between the clamping surfaces and leaving the one Printing unit in an upwardly inclined direction.

With this device, the pressman takes the printing plate, guides it past the side of the roller facing the printing unit and inserts it into the device for clamping the printing-plate leading edge, the printing plate being positioned in a conventional manner by register pins and U-shaped cutouts. The device permits printing plates with bent-away trailing edges to be fed without problem to the printing press, it being necessary, of course, for the distance between the roller and the parts of the printing unit or of a protective guard of the printing unit to which the roller is attached to be of such length that the bent-away trailing edge can pass the roller by.

There is a further significant advantage over manual insertion of the printing plate:

With manual insertion, it is possible that, prior to clamping, the pressman has not held the printing plate accurately, so that register errors occur even when clamping. Because the pressman, with the device according to the invention, merely introduces the printing plate into the device for clamping the leading edge of the printing plate and then releases it, the printing plate being there under its own weight and being held by the roller, it is possible to clamp the printing plate more accurately. The reason therefor is that the printing plate is positioned in the holding device under its own weight without any forces acting thereon. When the printing plate is held by hand, such forces occur, which results in the aforementioned register errors.

The device is of simple construction, can be manufactured at low cost and is not complicated to use. The feeding path of the printing plate along the straight line which leaves the printing unit in an upwardly inclined direction can be effected with a comfortable body posture, it being possible for the printing plate to be brought relatively easily into its precise position. Damage to the printing plate is scarcely possible, because the printing plate is guided on its image side by at least one relatively easily rotatable roller. Such rollers must, by their length and/or disposition, be so constructed as to eliminate sagging of the printing plate in its central region. Most advantageous is a continuous roller of a length or breadth corresponding to the width of the printing plate. Printing plates of great length may also be guided by means of a plurality of rollers disposed one above the other. Operational reliability, as well as precise feeding of the printing plate, are assured to a high degree by the device according to the invention.

In accordance with another feature of the invention, at least another element for holding and guiding the printing plate is disposed above the roller, the other element being a holding device for gripping the printing plate by suction, yet being slidable on the printing plate, the holding device, in the plate-changing position, being disposed substantially on the straight line leaving the one printing unit in the upwardly inclined direction.

An advantage of this further development of the invention is that it is also possible, in a relatively simple manner, for large printing plates to be introduced into the device and to be held by the latter. As a result of being suction-gripped, the printing plate is somewhat tautened, so that the printing plate is already in good contact with the plate cylinder when the cylinder starts to rotate. Because the printing plate is not suction-gripped on its image side, there is no risk of damage to the printing area.

A plurality of embodiments are conceivable for the additional holding device, it being important, however, that printing plates with bent-away trailing ends be also usable. For this purpose, and in accordance with a further feature of the invention, for feeding a printing plate having an angularly bent-away trailing edge, the holding device has means for releasing the suction grip thereof on the printing plate before the bent-away trailing edge is fed to the holding device.

A number of further developments of the invention relate to the arrangement of the elements for holding and guiding the printing plate. For example, in accordance with an added feature of the invention, the at least one element for holding and guiding the printing plate is disposed on an upwardly swingable protective guard for the one printing unit. Such a printing-unit protective guard must be present on every printing unit anyway in order to prevent accidents. Such a printing-unit protective guard would also be swung upwardly conventionally for manually feeding a printing plate. The element or elements for holding and guiding the printing plate can, therefore, be brought into position by means of an operation which the pressman has to perform anyway.

In accordance with an additional feature of the invention, the printing-unit protective guard has a lower part whereon the at least one element for holding and guiding the printing plate is disposed, the lower part being movable into a position wherein the at least one element is disposed substantially on the straight line leaving the one printing unit in the upwardly inclined direction.

In accordance with yet another feature of the invention, a guide is disposed on the one printing unit, the lower part of the protective guard being displaceably held at a lower end thereof in the guide, the protective guard having an upper part forming, together with a lever, an angle-shaped arm pivotally mounted on the one printing unit, the upper part and the lower part of the printing-unit protective guard being connected to one another by an articulating joint, the lever together with the upper part attached thereto being swivellable on the one printing unit so as to bring the lower part into engagement with a stop formed on the guide, whereby the element for holding and guiding the printing plate is bringable into the plate-changing position thereof, wherein it is disposed substantially on the straight line.

In accordance with yet a further feature of the invention, a gas-pressure spring is connected at respective ends thereof to respective locations on the lever and on the printing unit so that a part of the lever extending from the location thereon to the end thereof mounted on the one printing unit, the gas-pressure spring, and bearings for the lever and the gas-pressure spring on the one printing unit form a triangle, the triangle having different angle relationships in upwardly swung and downwardly swung conditions of the printing-unit protective guard, the different angle relationships, as well as a dimensioning of the force of the gas-pressure spring forming respective force relationships so that the gas-pressure spring is extended and holds the printing-unit protective guard in the upwardly swung condition thereof but, in the downwardly swung condition of the printing-unit protective guard, the weight of the printing-unit protective guard holds the gas-pressure spring in a compressed and retracted condition thereof.

In accordance with yet an added feature of the invention, a pneumatic element is disposed between the lever and the printing unit, the pneumatic element engaging the lever part and being actuatable for opening and closing the printing-unit protective guard. It is possible, in this manner, for the printing-unit protective guard to be opened and closed automatically, i.e., it is also possible for the elements for holding and guiding the printing plate to be brought automatically into the plate-changing position.

In order for the printing plate to be guided without sagging, and in accordance with yet an additional feature of the invention, the at least one roller is formed as a continuous roller having a breadth at least equal to the width of the printing plate. In order to prevent damage to the printing plate and to assure reliable guidance, and in accordance with still another feature of the invention, the roller is equipped with rings of elastic material projecting beyond the surface of the roller. The number of rings distributed across the roller must be such that the printing plate is securely guided without any sagging. Ease of rotation of the roller is provided, in accordance with still a further feature of the invention, when the at least one roller is journalled in ball bearings.

In accordance with still an added feature of the invention, the holding device is a suction cup, and control means are included for venting the suction cup.

In accordance with still an additional feature of the invention, the holding device is a suction bar having a partial vacuum applied thereto, and control means are included having a two-way valve for connecting atmospheric pressure to the suction bar in place of the partial vacuum.

When a holding device of the foregoing type releases the printing plate, the end of the printing plate drops down slightly under its own weight, removing itself from the holding device to such an extent that there is no longer the possibility of a collision between the angularly bent-away trailing edge of the printing plate and the holding device.

In accordance with another feature of the invention, the printing plate is formed with a hole, and the holding device comprises a suction cup having a sealing, elastic suction lip for sealing off a space within the suction cup when the printing plate is pressed against the suction lip, the suction lip being formed of material having good sliding properties, the suction cup and the hole formed in the printing plate being disposed relative to one another so that, upon a sliding displacement of the printing plate, the hole formed in the printing plate passes the suction and into the space within the suction cup, in a printing plate-releasing condition of the holding device. With this device, the pressman puts the leading edge of the printing plate into a clamping device, guiding it past the rear side of the roller. The pressman then presses the non-printing side of the printing plate onto the suction cup or suction cups of the holding device. The printing press pulls in the printing plate which slides past the holding device until a hole in the printing plate passes the suction lip. The end of the printing plate is formed with such holes anyway, because they are needed for plate making and/or punching. As a result of venting by means of the hole, the holding device releases the printing plate, and the latter can be pulled farther into the printing press. Such automatic release, as mentioned hereinbefore, is necessary if a printing plate has an angularly bent-away trailing edge. Venting by means of the hole provides a prompt release of the printing plate, enabling the latter to be pulled into the printing press. It is also practical for the suction cup to be attached to the upwardly swingable printing-unit protective guard; if it is disposed on the lower part of the printing-unit protective guard, to which the roller, too, is attached, this ensures that, with the part of the printing-unit protective guard in the appropriate position, both holding devices are disposed substantially on the straight line.

To provide optimal operational reliability, it is necessary for the holding force of the additional holding device to be appropriately dimensioned. The necessary holding force depends upon the characteristics of the printing plate. The magnitude of the holding force can be set by means of the diameter of the suction lip of the suction cup and by the obtainable partial vacuum, an increase in the holding force being obtainable by an increase in the partial vacuum, in the suction-gripped condition, for example, by reducing the volume of the space, as well as by an increase in the diameter of the suction lip of the suction cup. The holding force must be at least of such magnitude that it is sufficient to hold the plate; it must, however, at most be of such magnitude that it is still possible for the suction lip to slide on the printing plate. Thus, in accordance with a further feature of the invention, the suction lip has a diameter and the space of the suction cup has a volume adequate for producing a holding force for simultaneously holding the printing plate and permitting sliding between the printing plate and the suction lip.

In accordance with an added feature of the invention, the space has a volume variably adjustable in accordance with a desired holding force. It is possible, in this manner, to adapt a holding device to various printing plates which, because of their weight and surface characteristics, require different holding forces.

In accordance with an additional feature of the invention, the space is formed in a rigid body, and the elastic suction lip is joined to the rigid body.

In accordance with yet another feature of the invention, the space is formed in a rigid body comprising a piston-cylinder unit having a piston displaceable in position in a cylinder thereof, the space having a volume adjustable by the position of the piston. The piston must be of such construction that its setting can no longer be unintentionally changed. This may, for example, be achieved by providing a threaded spindle extending outwardly through the rigid body, the spindle being turnable from outside. This also permits readjustment during operation.

A further influencing factor with regard to the magnitude of the holding force is the quantity of air that escapes from the suction cup when the plate is pressed on. In accordance with yet a further feature of the invention, the elastic suction lip has an edge spaced a given axial distance from the rigid body, in the plate-releasing condition of the holding device, and the suction lip is deformed so that the rigid body engages the printing plate, in a printing plateholding condition of the holding device.

In accordance with yet an added feature of the invention, the given axial distance is of such length that a partial vacuum required for the desired holding force is generated in the space when the printing plate is pressed against the suction lip.

In accordance with another feature of the invention, a press-on element is mounted in the one printing unit for catching and guiding the printing plate following release thereof by a last one of the at least one holding element.

In accordance with a further feature of the invention, the plate cylinder carries a device for clamping a trailing edge of a printing plate therein, and the printing plate is formed with a bent-away trailing edge portion pressable by the press-on element into the device for clamping the trailing edge of the printing plate therein.

The press-on element is disposed with a slight lateral offset at the lower end of the straight line which leads to the side of the roller facing towards the printing unit; in the plate-changing position, it extends between the clamping surfaces of the device for holding the printing-plate leading edge.

In accordance with a concomitant feature of the invention, and in order to provide the suction lip with the required sliding properties, it is formed, for example, of rubber having a hardness of 40 to 45 Shore.

Other features which are considered as characteristic for the invention are set forth in the appended claims.

Although the invention is illustrated and described herein as embodied in a device for feeding a printing plate to a plate cylinder of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
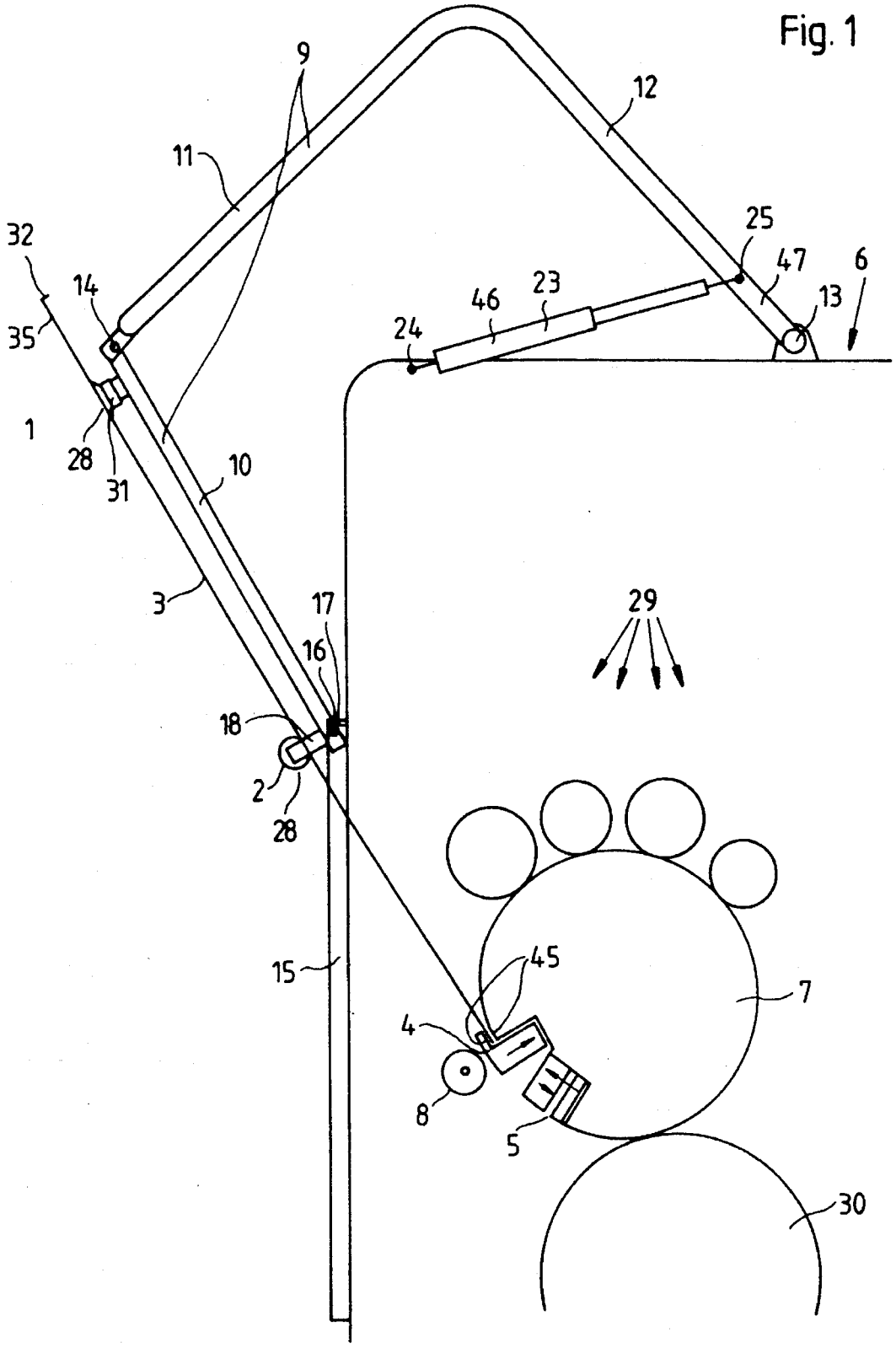
FIG. 1 is a diagrammatic side elevational view of an embodiment of the device for feeding a printing plate to a plate cylinder of a printing machine according to the invention, having two holding devices in plate-changing position disposed on a protective guard of a printing unit of the printing press.

Referring now to the drawings and, first, particularly to FIG. 1 thereof, there is shown therein an embodiment of the device for feeding a printing plate to a plate cylinder of a printing press, in accordance with the invention, wherein elements 28 for holding and guiding a printing plate 3 are attached to a lower part 10 of a protective guard 9 for a printing unit 6 of the printing press. The elements 28 are made up of a roller 2 in a lower region of the lower part 10 of the printing-unit protective guard 9 and a suction cup 31 at an upper end of the lower part 10 of the printing-unit protective guard 9. The printing-unit protective guard 9 is in an upwardly swung condition, wherein an upper part 11 of the printing-unit protective guard 9 forms, with a lever 12, an angle-shaped arm. The lever 12 is swivellably connected to the printing unit 6 by means of a bearing 13. The upper part 11 of the printing-unit protective guard 9 forms, with the lower part 10 of the printing-unit protective guard 9, the parts of the printing-unit protective guard which are swivellable in front of the printing unit 6 in order to prevent accidents. For this purpose, the two parts 10 and 11 of the printing-unit protective guard 9 are connected to one another in hinge-like manner by means of an articulating joint 14. The lower part 10 of the printing-unit protective guard 9 is retained by means of guide pins 16, which run in a guide 15 of U-shaped section. Situated at the upper end of the guide 15 is a stop 17, which provides an upward limit on the movement of the guide pins 16. In the embodiment of the invention illustrated in FIG. 1, the printing-unit protective guard 9 is swung upwardly manually, and is held in the thus shown upwardly swung position by one gas-pressure spring or strut 23, or by a pair of them, one on either side. The gas-pressure spring 23 has a bearing 24 on the printing unit 6 and a bearing 25 on the lever 12. Both bearings 24 and 25 of the gas-pressure spring 23 form, together with the printing unit 6 and the part of the lever 12 between the bearing 13 and the bearing 25, a triangle formed with angles which vary as the printing-unit protective guard 9 is swung downwardly, as is apparent from a comparison of FIG. 1 and FIG. 2. In the position thereof shown in FIG. 1, the gas-pressure spring 23 requires a considerably smaller force for setting-up or swinging the printing-unit protective guard 9 upwardly than is required therefor from the position thereof shown in FIG. 2. The gas-pressure spring 23 can, therefore, be of such construction that, in the upwardly swung condition of the printing-unit protective guard 9, the gas-pressure spring 23 is extended and holds the printing-unit protective guard 9 in its position, the guide pins 16 being in contact on either side with the stops 17, however, in the downwardly swung condition of the printing-unit protective guard 9, the weight of the printing-unit protective guard 9 holds the gas-filled strut 23 in its compressed or retracted position. Such a construction offers the advantage that the pressman can, in one operation, swing the printing-unit protective guard 9 upwardly, and the printing-unit protective guard 9 then remains in that position, wherein both the roller 2 and the suction cup 31 are positioned in this manner, so that both the side of the roller 2 facing towards the printing unit 6, as well as the suction lip 33 of the suction cup 31 are situated on a straight line which extends parallel to clamping surfaces 45 of a device for holding a leading edge 4 of the printing plate 3, passes between the clamping surfaces 45, and leaves the printing unit 6 in an upwardly inclined direction.

Figure 2:
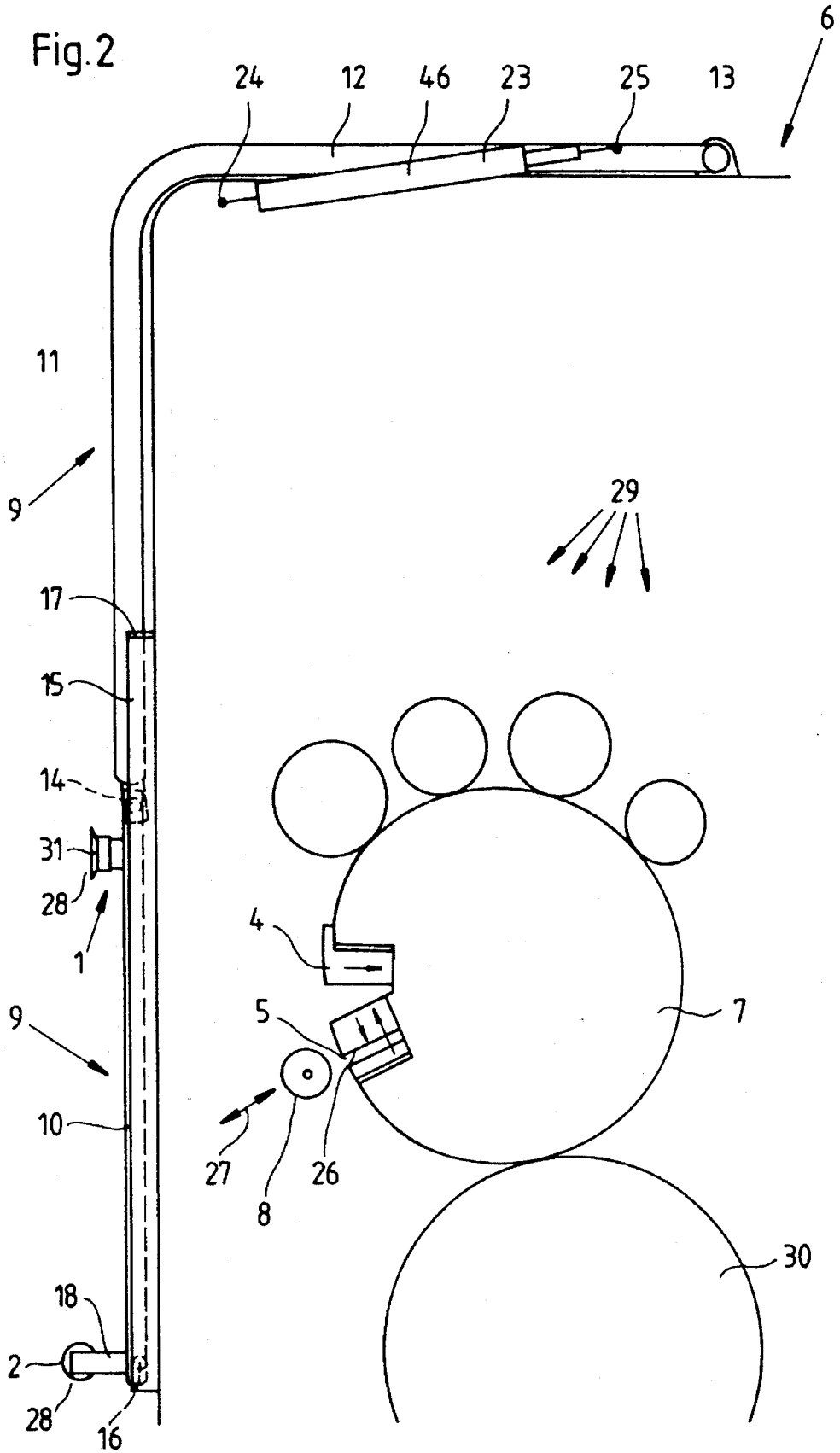
FIG. 2 is another view like that of FIG. 1 showing the feeding device in another operating phase thereof wherein the printing-unit protective guard is in a closed condition.

Instead of the gas-pressure spring 23, a pneumatic element 46 may also be provided, it being necessary for the pneumatic element 46 to produce an appropriate force for pressing the printing-unit protective guard 9 out of the closed position thereof shown in FIG. 2 and into the open position thereof shown in FIG. 1. It is also possible for the pneumatic element 46 to be disposed in such a manner that it engages a lever which, in the closed position of the printing-unit protective guard 9, assumes approximately the same position as the lever 12 does in the opened position of the printing-unit protective guard 9. In this manner, a smaller force of the pneumatic element 46 is required for operation.

In FIG. 1, the device for holding and guiding a printing plate is shown with a printing plate 3 which is formed with a hole 35 and an angularly bent-away printing-plate trailing edge 32. The printing plate 3 is inserted between the clamping surfaces 45 of the device 4 for holding the printing-plate leading edge. The device 4 is disposed in a channel or gap formed in the plate cylinder 7, the printing plate 3 being wound around the plate cylinder 7 due to the rotation of the latter. Disposed in the same channel or gap, or in the immediate vicinity of the device 4 for holding the printing-plate leading edge is a device 5 for holding the printing-plate trailing edge 32. A press-on element 8 is used to insert the angle-shaped printing-plate trailing edge 32 into the device 5 for holding the printing-plate trailing edge 32. The clamping surfaces of the device 5 are disposed in radial direction, so that, after the printing-plate trailing edge 32 has been clamped, a high force can be applied in order to tighten or tauten the printing plate 3. The plate cylinder 7 is supplied with ink by an inking unit 29 and forms a negative of the image to be printed, on a rubber-covered cylinder 30, which transfers the image to a paper sheet.

The pressman performs the feeding of the printing plate 3 by guiding the leading edge thereof past the side of the roller 2 facing the printing unit 6 and inserting it into the space between the clamping surfaces 45 for receiving and holding the leading edge of the printing plate 3. The precise positioning of the printing plate 3 is assured by register pins in the device 4 for holding the printing-plate leading edge, the register pins cooperating with U-shaped cutouts formed in the printing plate 3. The pressman presses the upper region of the printing plate 3 onto the suction cup 31, and then, by pressing a button conventionally causes the closing of the device 4 for holding the printing-plate leading edge, as well as the rotation of the plate cylinder 7, which then winds the printing plate 3 thereon. The instant the hole 35 slides under the suction lip 33 of the suction cup 31, the volumetric space within the latter is vented and the printing plate 3 is released. Under its own weight, the printing plate 3 then drops down a little, so that the bent-away printing-plate trailing edge 32 is able to slide past the suction cup 31. When the printing-plate trailing edge 32 passes the roller 2, it drops down slightly, in turn, but is caught by the press-on element 8, which finally inserts the printing-plate trailing edge 32 by a movement of the press-on element 8 in the direction of the double arrow towards the right-hand side of FIG. 2, which forces the trailing edge 32 of the printing plate 3 into the device 5. The short arrow superimposed on the clamping device 5 represents clamping by the movement of a clamping element of the device 5, and the adjacent long arrow represents the tensioning movement of both clamping elements of the device 5 for tensioning the printing plate 3.

FIG. 2 shows the same holding device as in FIG. 1 with the printing-unit protective guard 9, however, in closed condition. As shown, the gas-pressure spring 23 is in the aforementioned compressed or retracted condition. In the interior of the printing unit 6, the plate cylinder 7 is in a position wherein the press-on element 8 is inserting the bent-away printing-plate trailing edge 32 into the device 5 for holding the printing-plate trailing edge 32. In this position, the printing-unit protective guard 9 may already have been closed, but this need not be the case.

Figure 3:
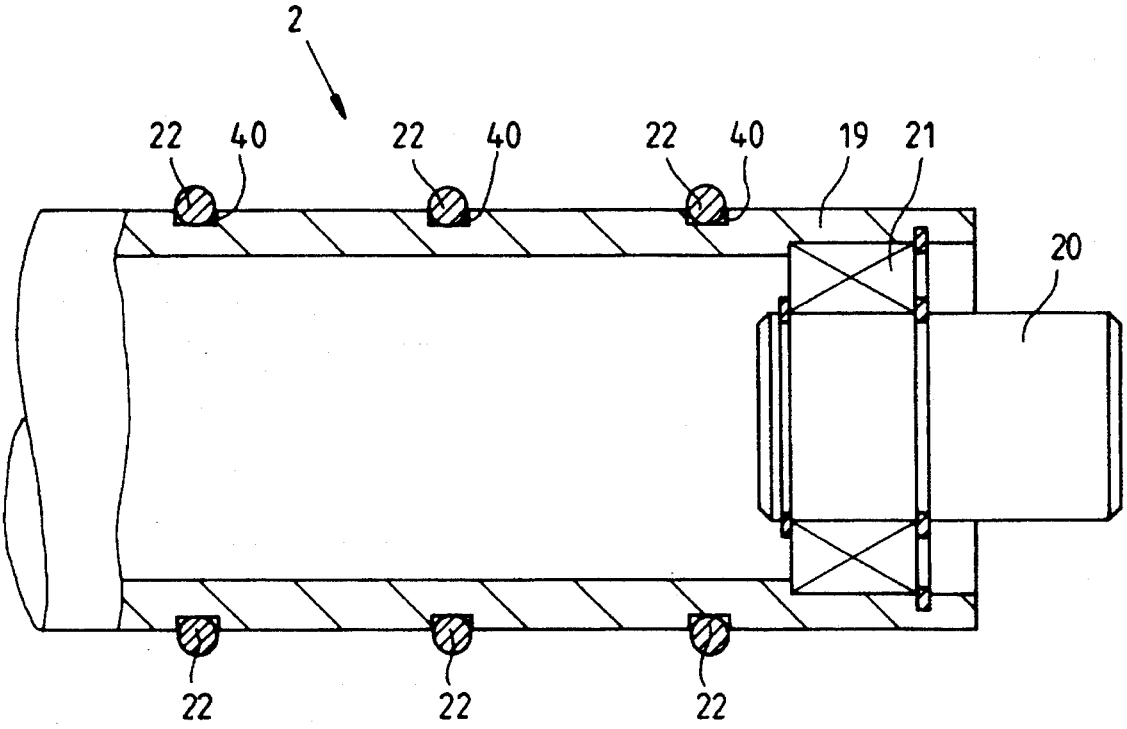
FIG. 3 is an enlarged fragmentary longitudinal sectional view of a roller forming part of the feeding device.

FIG. 3 illustrates an advantageous embodiment of the roller 2 which assures particularly careful handling of the printing plate 3. If a plurality of rollers 2 are employed, it is advantageous for them all to be of this construction. The roller 2 is formed of a tube 19 having a width or breadth which is at least equal to the width of the printing plate 3. Bearing journals 20 are mounted in the tube 19 at both ends thereof by means of ball bearings 21. As is apparent from FIGS. 1 and 2, the bearing journals 20 are supported in holders 18 which are attached to a lower part 10 of the printing-unit protective guard 9. The surface of the tube 19 carries rings 22 of an elastic material. The rings 22 are inserted in grooves 40 formed in the surface of the tube 19 and project beyond the surface, so that the printing plate 3 runs on the elastic material of the rings 22. The number of rings 22 depends upon how many support points are required in order to assure reliable and proper guidance of the printing plate 3.

Figure 4:
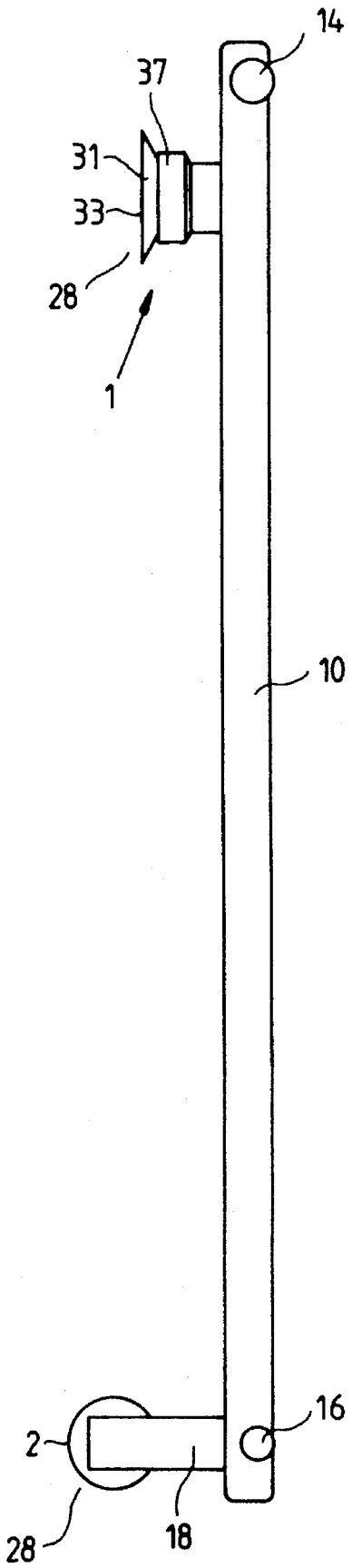
FIG. 4 is an enlarged fragmentary view, in a vertical disposition, of a lower part of a printing-unit protective guard with the roller and one of the holding devices in the form of a suction cup.

FIG. 4 shows the lower part 10 of a printing-unit protective guard 9, which has two elements 28 thereon for holding and guiding the printing plate 3. Attached to the lower end of the lower part 10, as shown in FIG. 4, the element 28 is in the form of the roller 2 carried by the holder 18 which, in turn, is attached to the lower part 10 of the printing-unit protective guard 9. The holder 18 is of such length as to permit the bent-away trailing edge 32 of the printing plate 3 to pass it by. Attached to the upper end of the lower part 10 of the printing-unit protective guard 9 is the other element 28 for holding and guiding the printing plate 3, which is formed as a suction cup 31 having a suction lip 33 of elastic material, the elastic suction lip 33 being attached to a rigid body 37. The precise construction of the suction cup 31 is described hereinbelow. Further provided at the upper end of the lower part 10 is an articulating joint 14 which joins the lower part 10 of the printing-unit protective guard 9 to the upper part 11 (FIG. 1) of the printing-unit protective guard 9. At the lower end of the lower part 10 is a guide pin 16 which, arranged on both sides in U-shaped guides 15 on the printing unit 6, can be suitably guided therein.

Figure 5:
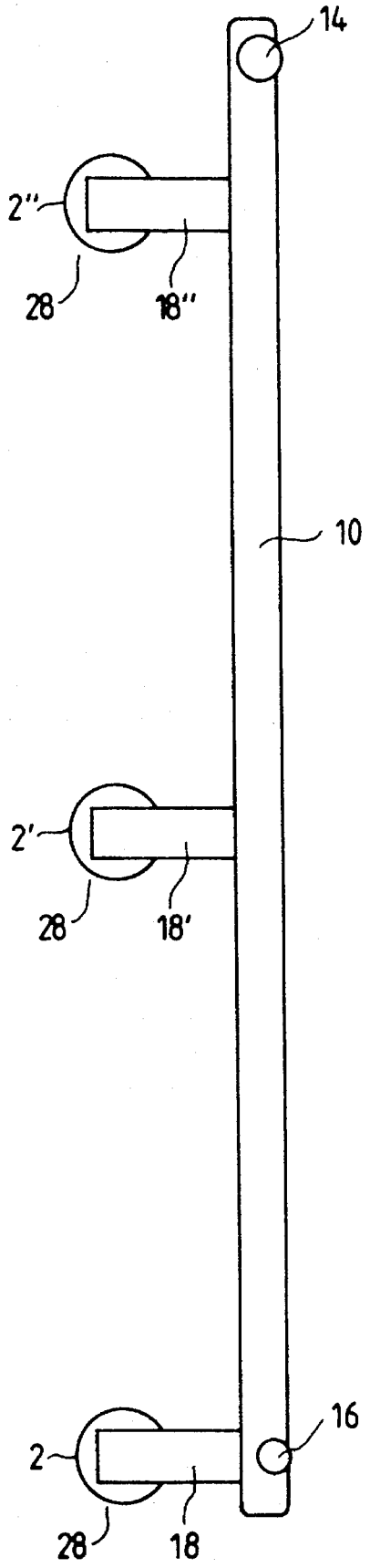
FIG. 5 is another view like that of FIG. 4 of another embodiment of the lower part of the protective guard provided with three of the rollers.

FIG. 5 shows another construction for the lower part 10 of the printing-unit protective guard 9, which, in contrast with the aforedescribed lower part, is provided with three elements 28 for holding and guiding the printing plate 3, namely in the form of three rollers 2, 2' and 2" of the type shown in FIG. 3. All of the rollers 2, 2' and 2" are carried by holders 18, 18' and 18" respectively, in the hereinabove-described manner. With this embodiment of the lower part 10 of the protective guard 9, the introduction of printing plates 3 with bent-away, angularly disposed trailing edges poses no problem, because the bent-away section at the trailing edge is directed inwardly and, consequently, passes the rollers 2, 2' and 2" without difficulty.

Figure 6:
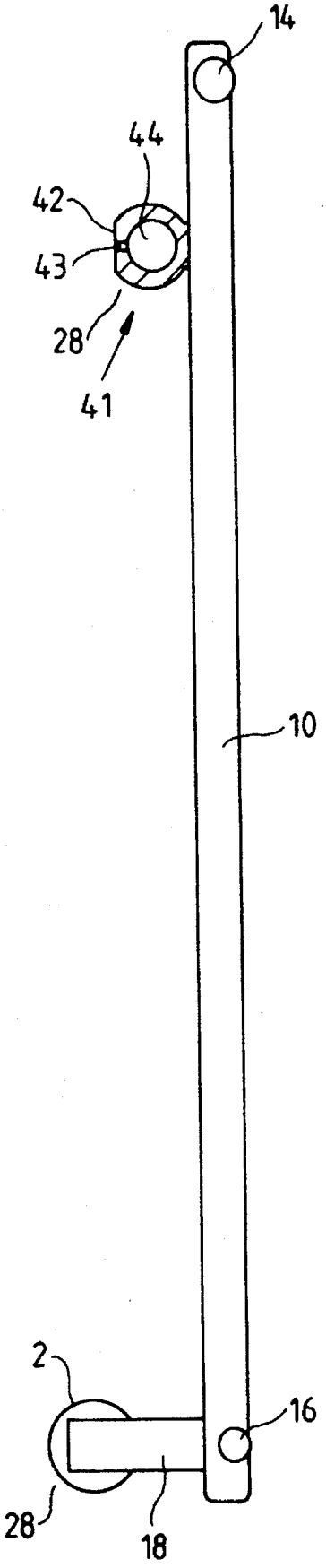
FIG. 6 is yet another view like that of FIG. 4 of a third embodiment of the lower part of the protective guard provided with the roller and a suction bar shown in a cross-sectional view.

FIG. 6 shows a further embodiment of a lower part 10 of the printing-unit protective guard 9, having two elements 28 for holding and guiding the printing plate. The lower element 28 is a roller 2 of the aforedescribed construction, and the upper element 28 is a suction bar 41 which has a sliding surface 42 formed with one or more outlet openings 43. The suction bar 41 is in the form of a tube 44 to which suction air is applied, atmospheric pressure being introducible into the tube 44 by means of a two-way valve when the printing plate 3 has to be released because of its bent-away trailing edge portion 32.

Figure 7:
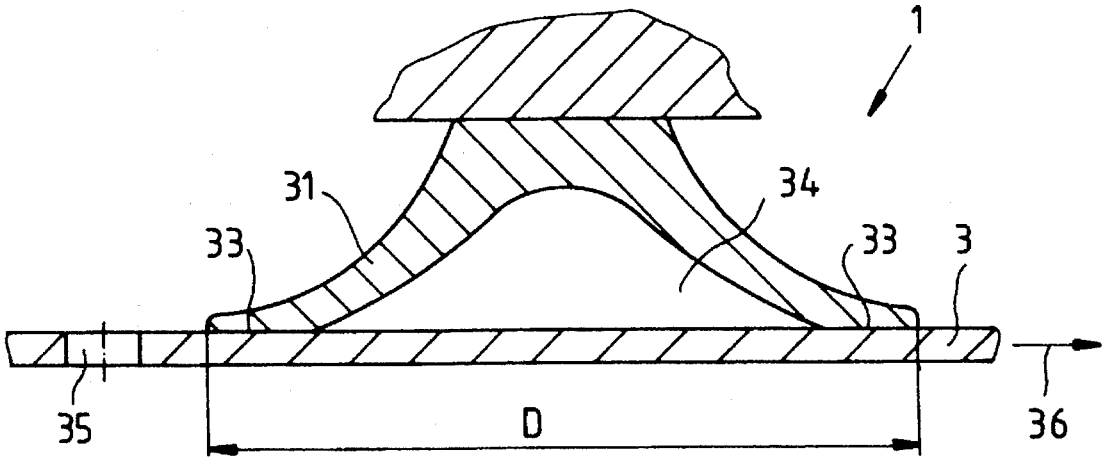
FIG. 7 is a much-enlarged sectional view of one of the suction cups holding a plate.

FIG. 7 shows a holding device 1 which is in the form of a suction cup 31 attached to the printing-unit protective guard 9, a printing plate 3 being pressed onto the suction cup 31 so as to be held thereby. The suction cup 31 is formed with a suction lip 33 which is elastic and seals off a volumetric space 34 in the suction cup 31. When the printing plate 3 had been pressed against the suction cup 31, some air had escaped from the space 34 so that a partial vacuum was generated therein for holding the printing plate 3. The printing plate 3 is displaced in the direction of the arrow 36. A hole 35, which is conventionally formed in the printing plate 3, and the suction cup 31 are disposed relative to one another so that, with the printing plate 3 in a position in which the holding device 1 is to release it, the hole 35 passes the suction lip 33 due to the displacement of the printing plate 3 in the direction of the arrow 36. Accordingly, the space 34 is vented and the suction cup 31 loses its hold on the printing plate 3. Several of the holes 35 are conventionally provided at each trailing end of a printing plate in order to position the printing plate correctly for plate making and/or for clamping in order to punch out the U-shaped cutouts.

The holding force of the suction cup 31 is determined by the diameter D of the suction lip 33, as well as by the partial vacuum and the size of the space 34. In this relatively simple embodiment, the partial vacuum and the size of the space 34 depend also on the force with which the printing plate 3 is pressed onto the suction cup 31. The highest partial vacuum and, thus, the greatest holding force are produced by a small space 34 which is greatly increased in size by a force pulling the printing plate 3 vertically away from the suction cup 31.

Figure 8:
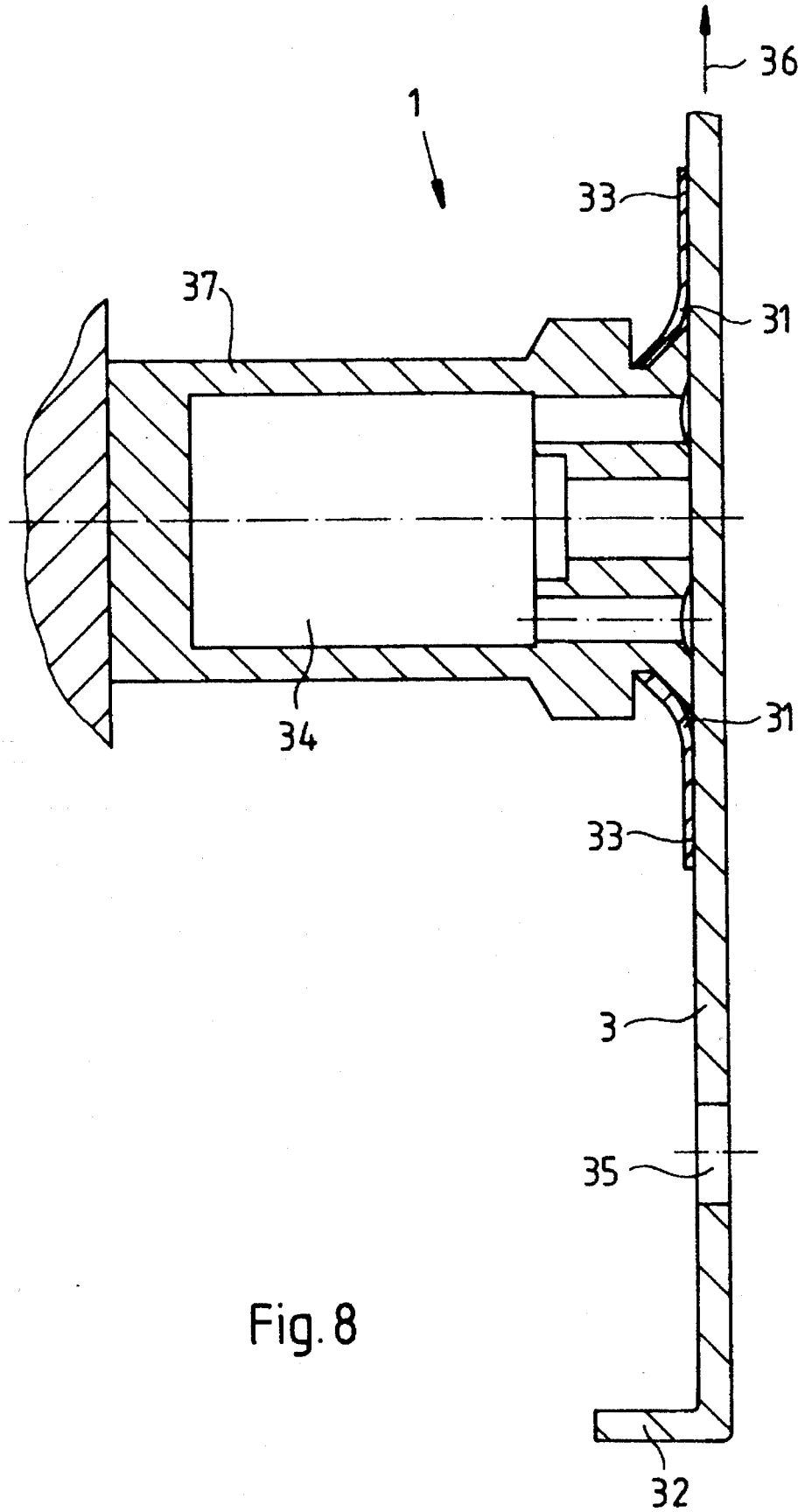
FIG. 8 is another view like that of FIG. 7 of another embodiment of the suction cup.

FIG. 8 shows an embodiment of the holding device 1 in which the space 34 is formed in a rigid body 37. The suction cup 31 is formed of a funnel-shaped suction lip 33 which is joined to the rigid body 37. It is apparent from FIG. 8 that the printing plate 3 has been pressed onto the suction cup 31 to such an extent that the rigid body 37 has come up against the printing plate 3. When the printing plate 3 was pressed against the suction lip 33, the latter was correspondingly deformed, a distance a (FIG. 9) between the edge of the suction lip 33, in a condition thereof wherein suction is not being applied, and the rigid body 37 having been eliminated. In this manner, a precisely defined quantity of air escapes and a defined vacuum is generated, due to which the holding force can be reproducibly set within a narrow tolerance range. This reproducible setting is of significance for the reason that, if the holding force is too great, the sliding resistance of the suction cup 31 on the printing plate 3 becomes too great; on the other hand, a defined holding force is necessary for securely holding the printing plate 3.

The printing plate 3 shown in FIG. 8 is a printing plate which, at its end, is formed with an angularly bent-away section 32 over which the holding device 1 is unable to slide away. It is necessary, therefore, for the suction cup 31 to release the printing plate 3 before the end region of the printing plate 3 is reached. This is taken care of by the hole 35 formed in the printing plate 3 which, as explained hereinbefore, is conventionally present therein anyway.

Figure 9:
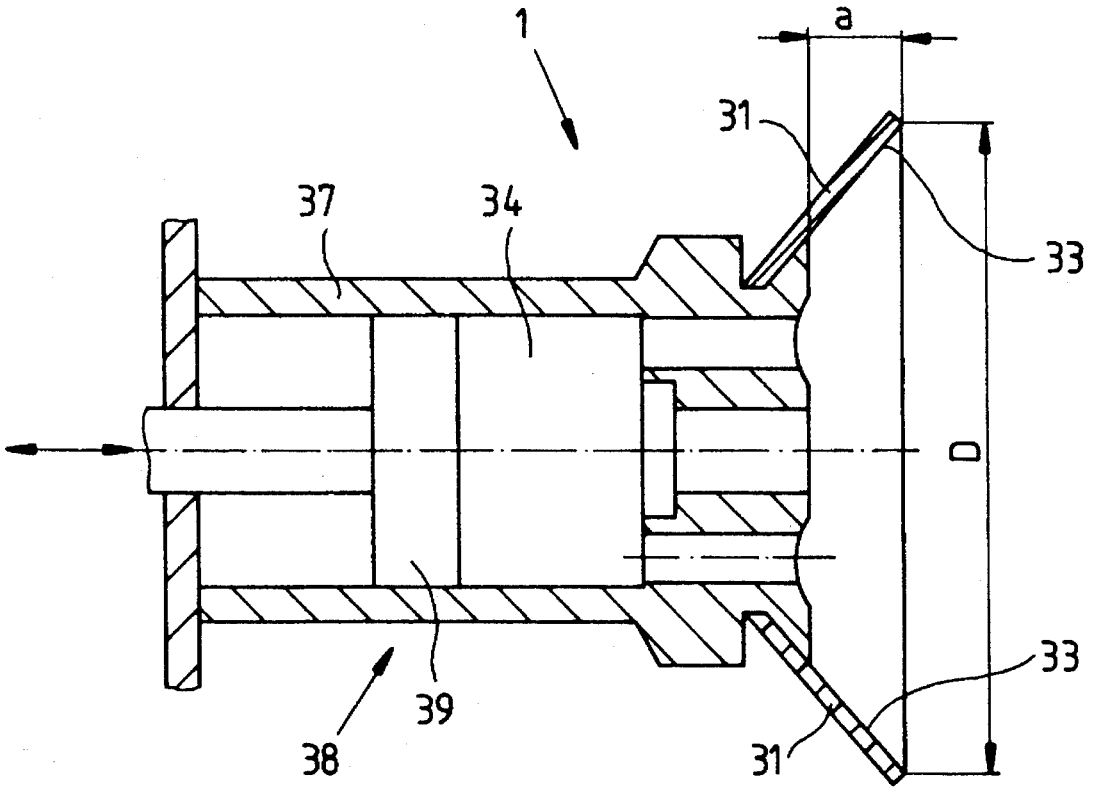
FIG. 9 is yet another view like that of FIG. 7 of yet another embodiment of the suction cup which is equipped for providing an adjustable holding force.

FIG. 9 shows a further embodiment of the holding device 1 wherein the suction cup 31 has a volumetric space 34 formed in the rigid body 37, which is constructed as a piston-cylinder unit. In this embodiment, the volumetric space 34 is adjusted by the position of the piston 39, for example, by means of a threaded spindle. The advantage thereof is that the partial vacuum can be adjusted according to the desired holding force. In a suitable embodiment, it is also possible for the adjustment to be made during operation. The adjustable volumetric space 34 ensures that printing plates 3 of different weight and different surface characteristics may be securely held while, nevertheless, the suction lip 33 is able to slide relatively easily on the printing plate 3.

The foregoing is a description corresponding in substance to German Application P 42 14 049.1, dated Apr. 29, 1992, the International priority of which is being claimed for the instant application, and which is hereby made part of this application. Any material discrepancies between the foregoing specification and the aforementioned corresponding German application are to be resolved in favor of the latter.

We claim:

1. Device for feeding a printing plate to a plate cylinder of a printing unit of a printing press, the printing unit having a protective guard with a lower part, the plate cylinder having a clamping device formed with clamping surfaces for clamping a leading edge of the printing plate therein, the feeding device defining a plate-changing position in which the printing plate is transferred to the plate cylinder, the feeding device comprising at least one element for holding and guiding the printing plate disposed on the lower part of the printing unit protective guard, said at least one element being a readily rotatable roller having an outer cylindrical surface movable to the plate-changing position in which said outer cylindrical surface is disposed substantially tangentially to a straight line extending parallel to and between the clamping surfaces of the clamping device and leaving the printing unit in an upwardly inclined direction, and suction cup means disposed above said roller for holding and guiding the printing plate, said suction cup means gripping the printing plate by suction yet being slidable on the printing plate, said suction cup means, in the plate-changing position, being disposed substantially on said straight line leaving the printing unit in the upwardly inclined direction.

2. Device according to claim 1, including means for feeding a printing plate having an angularly bent-away trailing edge, said suction cup means having means for releasing the suction grip thereof on the printing plate before the bent-away trailing edge is fed to said suction cup means.

3. Device according to claim 1, wherein the protective guard is an upwardly swingable protective guard at the printing unit, and wherein said at least one element for holding and guiding the printing plate is disposed on said upwardly swingable protective guard for the printing unit.

4. Device according to claim 3, wherein said printing-unit protective guard has a lower part whereon said at least one element for holding and guiding the printing plate is disposed, said lower part being movable into a position wherein said at least one element is disposed substantially on said straight line leaving the printing unit in said upwardly inclined direction.

5. Device according to claim 4, including a guide disposed on the one printing unit and a stop formed on said guide, a lever pivotably mounted on the printing unit, said lower part of said protective guard being displaceably held at a lower end thereof in said guide, said protective guard having an upper part forming, together with said lever, an angle-shaped arm pivotally mounted on the printing unit, said upper part and said lower part of said printing-unit protective guard being connected to one another by an articulating joint, said lever together with said upper part attached thereto being swivellable on the one printing unit so as to bring said lower part into engagement with said stop formed on said guide.

6. Device according to claim 5, including a gas-pressure spring connected at respective ends thereof to respective locations on said lever and on the printing unit so that a part of said lever extending from said location thereon to the end thereof mounted on the one printing unit, said gas-pressure spring, and bearings for said lever and said gas-pressure spring on the one printing unit define a triangle, the triangle having different angle relationships in upwardly swung and downwardly swung conditions of said printing-unit protective guard, the different angle relationships and a dimensioning of a spring force of said gas-pressure spring forming respective force relationships so that said gas-pressure spring is extended and holds said printing-unit protective guard in the upwardly swung condition thereof but, in the downwardly swung condition of said printing-unit protective guard, the weight of said printing-unit protective guard holds the gas-pressure spring in a compressed and retracted condition thereof.

7. Device according to claim 5, including a pneumatic element disposed between said lever and the printing unit, said pneumatic element engaging said lever part and being actuatable for opening and closing said printing-unit protective guard.

8. Device according to claim 1, wherein said at least one roller is formed as a continuous roller having a breadth at least equal to the width of the printing plate.

9. Device according to claim 8, wherein said roller is equipped with rings of elastic material projecting beyond the surface of said roller.

10. Device according to claim 1, wherein said at least one roller is journalled in ball bearings.

11. Device according to claim 1, including control means for venting said suction cup.

12. Device according to claim 1, wherein said holding device is a suction bar having a partial vacuum applied thereto, and including control means having a two-way valve for connecting atmospheric pressure to said suction bar in place of the partial vacuum.

13. Device according to claim 1, including a press-on element mounted in the one printing unit for catching and guiding the printing plate following release thereof by a last one of said at least one holding element.

14. Device according to claim 13, wherein the plate cylinder carries a device for clamping a trailing edge of a printing plate therein, and wherein the printing plate is formed with a bent-away trailing edge portion pressable by said press-on element into said device for clamping the trailing edge of the printing plate therein.

* * * * *